United States Patent [19]

Hoskinson

[11] Patent Number: 4,883,003

[45] Date of Patent: Nov. 28, 1989

[54] SECONDARY COMBUSTION CHAMBER FOR AN INCINERATOR

[76] Inventor: Gordon H. Hoskinson, 186 Mayfair Rd., Floral Park, N.Y. 11001

[21] Appl. No.: 249,333

[22] Filed: Sep. 26, 1988

[51] Int. Cl.[4] ..... F23G 7/06

[52] U.S. Cl. ..... 110/212; 110/214; 110/244

[58] Field of Search ..... 110/205, 212, 211, 214, 110/210, 244

[56] References Cited

U.S. PATENT DOCUMENTS

| | | | |
|---|---|---|---|
| 3,602,161 | 8/1971 | Wyrough | 110/212 |
| 3,610,179 | 2/1971 | Shaw, Jr. | 110/214 |
| 3,785,305 | 1/1974 | Schrage | 110/212 |
| 3,858,533 | 1/1975 | Lowe | 110/8 C |
| 4,291,633 | 9/1981 | Hoskinson | 110/235 |
| 4,332,206 | 6/1982 | Tucker et al. | 110/203 |
| 4,356,778 | 11/1982 | McKee, Jr. | 110/212 |
| 4,379,433 | 4/1983 | Hoskinson | 110/214 |
| 4,452,152 | 6/1984 | John et al. | 110/214 |
| 4,512,264 | 4/1985 | Crawford | 110/160 |
| 4,538,529 | 9/1985 | Temelli | 110/214 |
| 4,674,417 | 6/1987 | Hoskinson | 110/214 |

*Primary Examiner*—Henry C. Yuen

*Attorney, Agent, or Firm*—Andrus, Sceales, Starke & Sawall

[57] ABSTRACT

An incinerator having an improved secondary combustion chamber. The incinerator includes a vertical stack through which the waste products of combustion are discharged and the upper end of the stack is connected to one end of an elongated, horizontal secondary combustion chamber. A plurality of hollow tubes, preferably formed of silicon carbide, are mounted in the wall of the chamber and extend radially of the chamber. Air is introduced into each of the tubes and is discharged from each tube through a plurality of holes that extend normal to the longitudinal dimension of the chamber. The discharge of air from the tube forms a series of air curtains which slows the flow of the waste gases and promotes combustion of any combustible residue in the waste gas.

9 Claims, 2 Drawing Sheets

FIG. 1
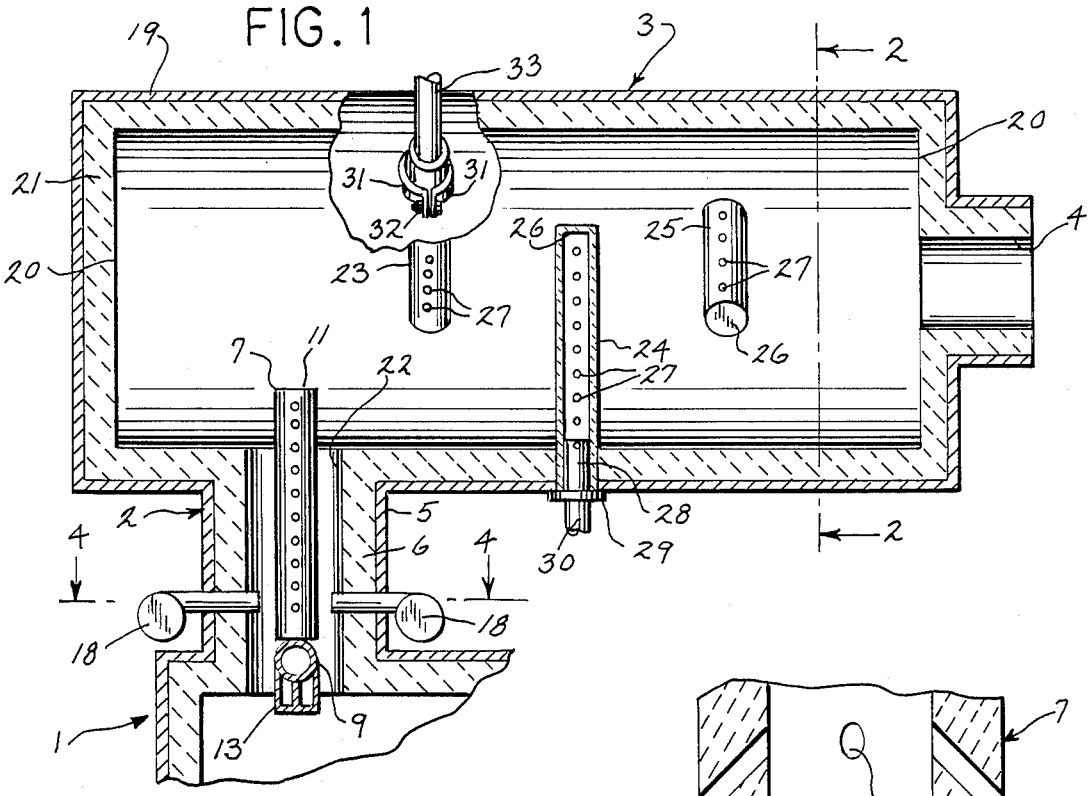
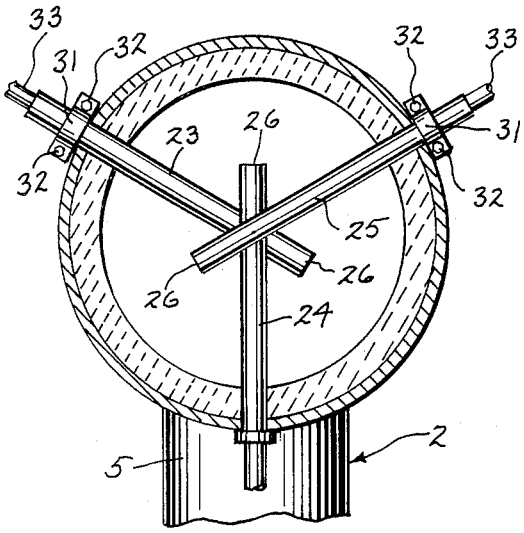
FIG. 2
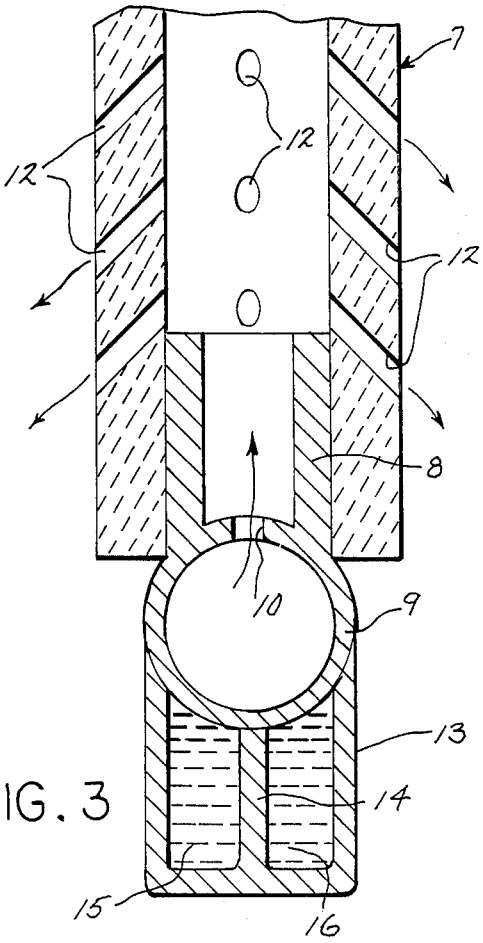
FIG. 3

SECONDARY COMBUSTION CHAMBER FOR AN INCINERATOR

BACKGROUND OF THE INVENTION

Difficulties have been experienced in incinerator design in achieving complete combustion of the waste material. In order to increase the efficiency of the combustion and reduce the discharge of pollutants into the atomsphere, the incinerator often includes a secondary zone of combustion and air is delivered to the secondary combustion chamber to burn any combustible residue in the waste gases.

Recently, through the increased use of plastic materials, it has been found that the conventional incinerator system is not totally effective in preventing the discharge of gaseous pollutants to the atmosphere. This is due to the greater BTU content of the plastic material and the higher temperatures involved in the combustion.

When a charge of highly flammable material, such as plastic, is fed to the incinerator, there may be insufficient air to completely burn the charge with a result that a short surge of smoke may be emitted from the incinerator. To eliminate this problem many municipalities require a secondary combustion chamber which is connected to the stack and air is supplied to the secondary combustion chamber to completely combust any residual combustible material in the waste gases. The conventional secondary combustion chamber normally includes a refractory lined chamber along with baffling to slow the flow of waste gases through the chamber. However, due to the intense heat that is involved in the secondary combustion chamber maintenance and repair of the chamber is commonly required.

SUMMARY OF THE INVENTION

The invention is directed to an improved secondary combustion chamber for an incinerator. The incinerator includes a vertical stack through which the waste gases of combustion are discharged and the upper end of the stack is connected to one end of an elongated, generally horizontal secondary combustion chamber.

A plurality of hollow ceramic tubes, preferably formed of silicon carbide, are mounted in the wall of the chamber and extend radially across the chamber. Air is introduced into each of the tubes and is discharged from each tube through a plurality of holes that preferably extend generally normal to the longitudinal axis of the chamber. The discharge of air from the tubes forms a series of air curtains which slows the flow of waste gases and enables any combustible residue in the gases to be completely combusted.

The construction of the invention provides complete combustion of the waste gases and eliminates the possiblity of smoke surges which can commonly occur when charges of highly flammable material are fed to the incinerator.

The air tubes in the secondary combustion chamber are formed of a heat resistant ceramic material which is capable of withstanding the intense heat in the chamber and thus require minimum maintenance.

The construction of the invention also provides a novel mounting mechanism for the tubes within the secondary combustion chamber so that the tubes can be readily installed or removed.

Other objects and advantages will appear in the course of the following description.

DESCRIPTION OF THE DRAWINGS

The drawings illustrate the best mode presently contemplated of carrying out the invention.

FIG. 1 is a vertical section showing a portion of an incinerator and the secondary combustion chamber;

FIG. 2 is a section taken along line 22 of FIG. 1;

FIG. 3 is an enlarged vertical section illustrating the air tube of the stack;

DESCRIPTION OF THE ILLUSTRATED EMBODIMENT

FIG. 1 shows an industrial or commercial type incinerator 1 that can be constructed in accordance with the incinerator as illustrated in U.S. Pat. No. 4,674,417 and the construction of the incinerator of that patent is incorporated by reference herein. The waste gases produced by burning of a combustible material in incinerator 1 are discharged through a vertical stack 2. The upper end of stack 2 communicates with one end of an elongated, generally horizontal secondary combustion chamber 3 and the waste gases after passing chamber 3 are discharged to the atmosphere through an outlet 4.

Figure 4:
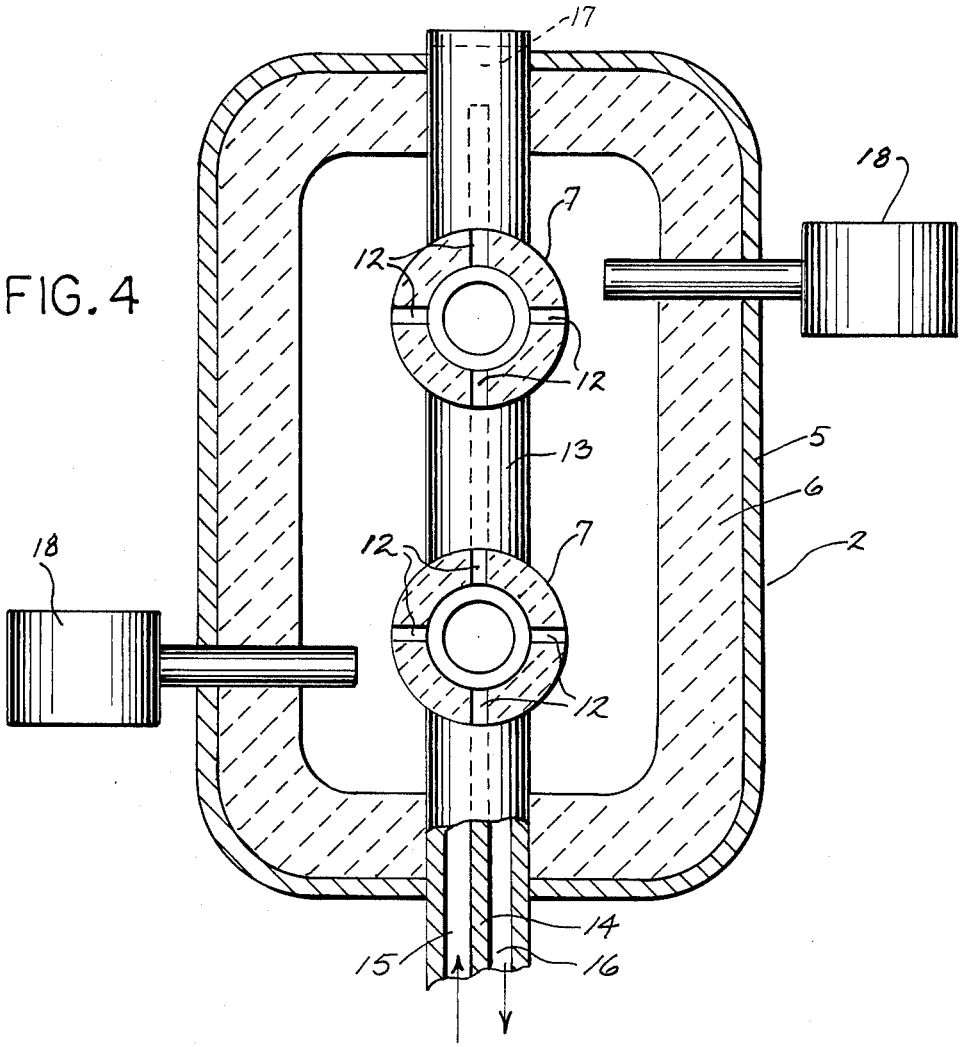
FIG. 4 is a horizontal section taken along line 4–4 of FIG. 1.

Stack 2 is composed of an outer metal shell 5 which is generally oval in horizontal section as best shown in FIG. 4. a heat resistant refractory lining 6 is located on the inner surface of shell 5.

Mounted within the stack 2 is a pair of parallel vertical air tubes 7. Air tubes 7 are preferably constructed of a ceramic material, such as silicon carbide, and can be constructed in the manner described in U.S. Pat. No. 4,674,417.

The lower end of each tube 7 is open and as illustrated in FIG. 3, is disposed aroung a short length of tubing 8 that extends upwardly from horizontal air duct 9. One end of the air duct 9 is connected to a suitable source of air under pressure such as a blower, not shown, while the opposite end of air duct 9 is closed off. Air being introduced into the duct 9 flows through holes 10 into the tubing 8 and then into the respective air tubes 7.

Thew upper end 11 of each air tube 7 is closed off and the side wall of each tube is provided with a plurality of outlet ports 12 which extend downwardly and radially outward to direct air against the refractory lining 6 of the stack. The ports 12 are preferably located at an angle of about 30° to 60° with respect to the horizontal. As the air tubes 7 have a substantial wall thickness, generally in the range of about 1 inch, ports 12 serve as nozzles or jets so that the air will be directed at high velocity downwardly and outwardly toward the refractory wall. The air blasts through the combustion gases flowing upwardly within the stack 2 to create extreme turbulence and mixing. This results in extremely high temperatures being generated in the stack 2 and the reflected heat from the refractory liner aids in achieveing combustion of the waste gases.

To cool the air being introduced into the stack, a cooling jacket or shroud 13 is secured to the lower surface of the air duct 9. Cooling jacket 13 includes a longitudinal divider wall 14 which divides the jacket into an inlet chamber 15 and an outlet chamber 16. An opening 17 in the divider wall provides communication between the ends of chambers 15 and 16. A cooling medium, such as water, is introduced into the inlet chamber 15 and the water will flow through the connecting opening 17 to the outlet chamber 16 where it is discharged. The cooling medium serves to maintain the air in an optimum and uniform temperature for efficient combustion.

One or more conventional gas or other fuel burners 18 can be mounted in the lower end of stack 2. The burners act in a conventional manner to provide a mixture of fuel and air to the lower portion of the stack and the mixutre can be ignited by a conventional igniter not shown. The burners 18 are generally operated only at start up of the incineration process and after a short period, the stack temperature will normally be sufficiently high to support combustion so that operation of one or all the burners may be discontinued.

Secondary combustion chamber 3 includes a generally cylindrical metal shell 19 which is enclosed at opposite ends by heads 20. A liner of conventional refractory material 21 is disposed on the inner surface of the shell 19 and heads 20. One end portion of shell 19 is provided with an opening 22 which communicates with the upper end of stack 2 so that the waste gases will flow from the stack into the chamber 3.

Figure 5:
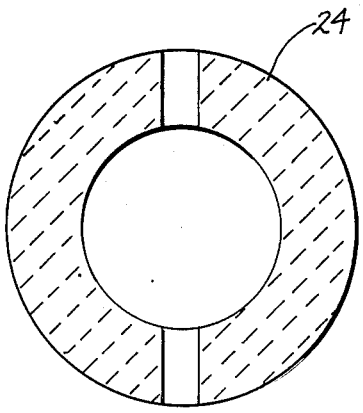
FIG. 5 is a transverse section of one of the air tubes in the secondary combustion chamber.

In accordance with the invention, a plurality of air tubes 23, 24, 25 are mounted in the wall of shell 19 and each tube extends generally radially of the chamber 3. Tubes 23, 24, 25 are formed of a heat resistant ceramic material, preferably silicon carbide, and the inner end 26 of each tube is closed off. As best illustrated in FIGS. 1 and 5, each tube 23, 24, 25 is provided with two rows of special outlet openings or ports 27 which are located diametrically opposite. Each row ends substantially the full length of the respective tube 23, 24, 25. The axes of the ports 27 are preferably disposed generally perpendicular or normal to the longitudinal axis of the chamber 3 and air being discharged from the ports 27 provides a plurality of longitudinally air spaced curtains which act to slow the flow of the waste gases through chamber 3 and provide complete combustion of any residual combustible material in the waste gases.

While the drawings have illustrated three air tubes 23, 24, 25 being utilized, depending on the nature of the incineration process and the size of the secondary combustion chamber 3, one or more such tubes can be utilized.

Tube 24 which is mounted within the lower portion of shell 19 is disposed around a hollow post 28 having a flange 29 which is secured by bolts or the like to the outer surface of shell 19. The lower end of tube 24 surrounds the post and rests on flange 29 so that the tube can be readily and removed from the chamber 3 by removal of post 28. Air is supplied to the interior of the tube 24 through an air conduit 30 which communicates with a blower or other source of air under pressure, not shown.

Figure 6:
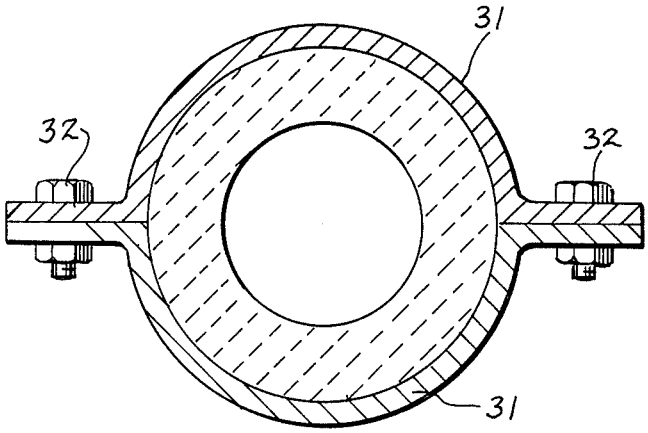
FIG. 6 is a transverse section showing the mounting of an air tube to the secondary combustion chamber.

Air tubes 23 and 25 are mounted in the upper portion of the chamber 3 and to provide this mounting, a pair of clamp halves 31 are secured around the outer end of each tube 23 and 25, as best shown in FIG. 6 and the clamp halves are connected together by bolts 32. With the clamp halves 31 secured to the outer end of the tube, the air tubes 23 and 25 are inserted within aligned openings in shell 19 and refractory liner 21 and the clamp will engage the outer surface of the shell to maintain the tubes 23 and 25 in proper position within the secondary combustion chamber 3. Air is supplied to the interior of the tubes 23 and 25 through air conduits 33 which are connected to a blower or other source of air under pressure not shown.

The air being discharged from the holes or ports 27 and air tubes 23, 24 25 forms a series of transverse, longitudinally spaced, air curtains and the waste gases flowing horizontally through the secondary combustion chamber 3 will engage and blast through the air curtains providing mixing and turbulence to increase the efficiency of the combustion operation.

Through the use of the secondary combustion chamber construction of the invention, complete combustion of the waste gases is achieved which eliminates any possibility of smoke surges. Further, the construction provides minimum back pressure to the flow of gas through the chamber 3.

The air tubes 23, 24, 25 being formed of a ceramic material, such as silicon carbide, are heat resistant and are capable of withstanding the intense temperatures encountered in the secndary combustion chamber. Moreover, the air tubes 23, 24, 25 can be readily installed and removed from the chamber 3, as desired.

Various modes of carrying out the invention are contemplated as being within the scope of the following claims particulary pointing out and distinctly claiming the subject matter which is regarded as the invention.

I claim:

1. In an incinerator apparatus, an incinerator to burn waste material, a stack connected to the incinerator for discharging waste gases of combustion, a housing defining a secondary combustion chamber having an inlet connected to the upper end of said stack and having an outlet, at least one tube formed of ceramic material extending transversely of said chamber, said tube having an outer end connected to said housing and having a closed inner end, said tube extending more than one half the cross sectional dimension of said chamber, means for supplying air to the outer end of said tube, said tube having a plurality of outlet ports with the axes of said ports disposed generally normal to the flow of waste gases through said chamber, air introduced into said tube being discharged through said ports to provide an air curtain extending, generally transversely across said chamber.

2. The apparatus of claim 1, wherein said tube is provided with two rows of said holes, a first of said rows being disposed diametrically opposite a second row of said holes.

3. The apparatus off claim 1, wherein said and said ports are spaced along the length of said tube.

4. In an incineration apparatus, an incinerator to burn waste material, stack means connected to the upper end of said incinerator for discharging waste gases of combustion, a secondary combustion chamber having a generally horizontal longitudinal axis, said chamber an inlet connected to the upper end of said stack means and having an outlet, a plurality of tubes disposed within said chamber, each tube extending generally transversely of said chamber and extending more than one-half the diameter of said chamber, said tubes being spaced longitudinally along the length of said chamber, each tube having an inner closed end and being provided with port means facing generally normal to the axis of said chamber, and means for introducing air into the interior of said tubes with said air being discharged from said port means to provide a plurality of longitudinally spaced transverse air curtains, said air curtains acting to slow the flow of waste gases through said chamber to provide complete combustion of said waste gases.

5. The apparatus of claim 4, wherein said port means comprises a row of spaced holes.

6. The apparatus of claim 4, wherein each tube is located at a different angle with respect to the axis of said chamber.

7. The apparatus of claim 5, wherein each tube is provided with two rows of said holes, a first row in each tube being disposed diametrically opposite a second row in each tube.

8. The apparatus of claim 4, wherein said tubes are composed of silicon carbide.

9. The apparatus of claim 4, wherein said stack means is connected to one end of said chamber and said outlet is in the opposite end.

* * * * *

UNITED STATES PATENT AND TRADEMARK OFFICE

CERTIFICATE OF CORRECTION

PATENT NO. : 4,883,003

DATED : November 28, 1989

INVENTOR(S) : GORDON H. HOSKINSON

It is certified that error appears in the above-identified patent and that said Letters Patent is hereby corrected as shown below:

Col. 4, Line 1, CLAIM 3, Delete "off" and substitute therefor ---of---; Col. 4, Line 1, CLAIM 3, Delete "and said"

Signed and Sealed this

Sixth Day of August, 1991

*Attest:*

HARRY F. MANBECK, JR.

*Attesting Officer*

*Commissioner of Patents and Trademarks*